United States Patent [19]

Allen

[11] 4,085,039

[45] Apr. 18, 1978

[54] MAGNETIC SEPARATOR WITH HELICAL CLASSIFYING PATH

[76] Inventor: James W. Allen, 8 Dover Ct., Orinda, Calif. 94563

[21] Appl. No.: 689,216

[22] Filed: May 24, 1976

[51] Int. Cl.[2] ..... B03C 1/24

[52] U.S. Cl. ..... 209/220; 209/227

[58] Field of Search ..... 209/214, 220, 39, 232, 209/1, 227

[56] References Cited

U.S. PATENT DOCUMENTS

| | | | |
|---|---|---|---|
| 1,056,318 | 3/1913 | Brück | 209/232 |
| 1,071,838 | 9/1913 | Weatherby | 209/220 |
| 1,491,600 | 4/1924 | Fernow | 209/232 |
| 1,527,069 | 2/1925 | Peck | 209/220 |
| 1,576,690 | 3/1926 | Ullrich | 209/214 |
| 2,612,262 | 9/1952 | Symington et al. | 209/39 |
| 3,279,602 | 10/1966 | Kottenstette et al. | 209/214 |
| 3,372,803 | 3/1968 | De Lisle et al. | 209/214 |
| 3,375,925 | 4/1968 | Carpenter | 209/214 |
| 3,722,677 | 3/1973 | Lehnert | 209/227 |
| 3,849,301 | 11/1974 | Reading | 209/214 |

*Primary Examiner*—Wilbur L. Bascomb, Jr.
*Attorney, Agent, or Firm*—Townsend and Townsend

[57] ABSTRACT

A continuous flow magnetic separator is disclosed for classifying magnetic and paramagnetic particles as concentrate from their mixture with ambient tailings. The separator includes a helical classifying path interior of a non-magnetic, non-conductive conduit, with the conduit wound along a path having an "uphill-downhill" slope with respect to the ambient gravitational bias. A magnetic field (preferably generated by an AC or DC energized coil) is aligned substantially coincident to the axis of generation of the helical path. This magnetic field is confined interior of a high permeability (preferably laminated) magnetic field conducting core having two elements. The first element, to which the coil is attached, is an outer cylindrical conductor (preferably closed at the bottom) defining interiorly thereof a cylindrically shaped inner volume. The second element is a cylindrical rotor having serrated edges and mounted for rotation about the axis of the helical path. The rotor defines between the outer cylindrical conductor and its rotating serrated edges a cylindrical gap into which the helical classifying conduit is placed. Particles to be classified are placed into the helical classifying conduit medially between the concentrate output at the upper end of the helix and the tailings output at the lower end of the helix. Upon rotation of the rotor to wind the magnetic and paramagnetic particles "uphill", a concentrated magnetic field at the serrated edges winds the magnetic concentrate in the helical classifying path to the concentrate output. The tailings move in opposition to the concentrate, gravitationally moving on the downhill slope of the helix through the conduit to the tailings output.

12 Claims, 6 Drawing Figures

MAGNETIC SEPARATOR WITH HELICAL CLASSIFYING PATH

This invention relates to magnetic separators. Specifically, a continuous flow magnetic separator having a helical classifying path within a rotating magnetic field is disclosed.

SUMMARY OF THE PRIOR ART

Magnetic separators having circuitous classifying paths are known. Typically, such devices include magnetized armatures rapidly rotating having complex electrical connections. Commonly, a magnetic field is communicated at spaced apart points to a circuitous path by a variety of arms. Such separators require complex mechanical connections and armatures to communicate the magnetic field to the classifying path. Further, such armatures are not capable of accommodating gravitationally sloped paths. Flow of tailings under gravity cannot occur in such separators.

Additionally, separators having individually switched magnetic fields are known. Such separators suffer from the disadvantage of having either complex windings or alternately elaborate switching equipment for switching the magnetic field. Moreover, switched magnetic fields have limits in the gradient available for classification due to the generation of closely opposed magnetic fields.

SUMMARY OF THE INVENTION

A continuous flow magnetic separator is disclosed for classifying magnetic and paramagnetic particles as concentrate from their mixture with ambient tailings. The separator includes a helical classifying path interior of a non-magnetic, non-conductive conduit, with the conduit wound along a path having an "uphill-downhill" slope with respect to the ambient gravitational bias. A magnetic field (preferably generated by an AC or DC energized coil) is aligned substantially coincident to the axis of generation of the helical path. This magnetic path is confined interior of a high permeability (preferably laminated) magnetic field conducting core having two elements. The first element, to which the coil is attached, is an outer cylindrical conductor (preferably closed at the bottom) defining interiorly thereof a cylindrically shaped inner volume. The second element is a cylindrical rotor having serrated edges and mounted for rotation about the axis of the helical path. The rotor defines between the outer cylindrical conductor and its rotating serrated edges a cylindrical gap into which the helical classifying conduit is placed. Particles to be classified are placed into the helical classifying conduit medially between the concentrate output at the upper end of the helix and the tailings output at the lower end of the helix. Upon proper rotation of the rotor, a concentrated magnetic field at the serrated edges winds the concentrate in the classifying path in the "uphill" direction to the concentrate output. The tailings move in opposition to the concentrate, gravitationally moving on the downhill slope of the helix through the conduit to the tailings output.

OBJECTS AND ADVANTAGES OF THE INVENTION

An object of this invention is to disclose a continuous flow magnetic separator having an elongate classifying path. According to this aspect, the classifying path is formed in the shape of a helix having at least a plurality of complete turns. The helix is sloped at all points along its path so that the ambient particle flow can occur with at least the assistance of gravity. Typically, tailings move of their own mass under force of gravity from an elevated input in the helix downhill to an output. Concentrate (consisting of magnetic and paramagnetic particles) is wound uphill in the helix by a rotating magnetic field uphill in the helix to a concentrate output.

An advantage of the helical classifying path is that tailings intermixed with ambient concentrate can be submitted to a relatively long downhill flow within the classifying ambient of the rotating magnetic field. Superior removal of magnetic and paramagnetic particles from the tailings can occur during the lengthy and circuitous classifying path. A classifying apparatus with improved one pass performance results.

A further object of this invention is to disclose apparatus for producing a rotating magnetic field which is naturally conformed to a simple north-south magnetic field, such as that produced by a single energized coil. According to this aspect of the invention, a cylindrical high permeability magnetic field conducting core consisting of an exterior stationary stator element and an interior rotating rotor element is disclosed. The stator, which is closed at the bottom, defines interiorly thereof a cylindrical volume. A rotor having serrated edges is mounted interior of the cylindrical volume for rotation. The rotor defines a gap between the serrated edges and the interior cylindrical walls of the stator. By the expedient of mounting a helical coil to the stator element and allowing the magnetic field from the coil to pass through both stator and rotor, concentrated magnetic fields of high gradient are produced at each of the serrated edges of the rotor. Upon rotation of the rotor, rotation of the fields of high gradients occurs.

An advantage of this invention is that the field is produced by a simply constructed rotor. There is no need to construct complex radial arms and the like to product a rotating magnetic field.

Yet another advantage of the disclosed apparatus for producing a rotating magnetic field is that the rotating field is conformed to a naturally occurring north-south magnetic field. It is not necessary to have elaborate switching equipment, communicators, windings or the like to produce the rotating field. Rather, the rotating field results from a rotating element in a simple north-south magnetic field, such as that produced by an AC or DC energized coil.

A further advantage of this invention is that there is no need to rotate the magnetic coil. Specifically, the magnetic coil is disclosed as fixedly mounted to the stator.

Yet another advantage of this invention is that the magnetic field can be rotated at an easily adjustable rate. As the rate of rotor rotation is adjusted, the rotation of the fields of high gradient is likewise adjusted. The rate of rotor rotation can thus conform to optimum classification of the concentrate being classified.

Yet another object of this invention is to disclose a preferred apparatus for producing a concentrated magnetic field. According to this aspect of the invention, a stator having a smooth cylindrical sidewall and a rotor having a serrated edge are confronted. By the expedient of having the serrations vary from a valley spacing of approximately twice the gap to a ridge spacing defining the gap a concentrated magnetic field at the ridge can be produced.

An advantage of the disclosed serrated rotor is that it produces a substantially higher magnetic gradient for such rotating classifying magnetic fields than has heretofore been known.

Other objects, features and advantages of this invention will become more apparent after referring to the following specification and attached drawings in which.

Figure 1:
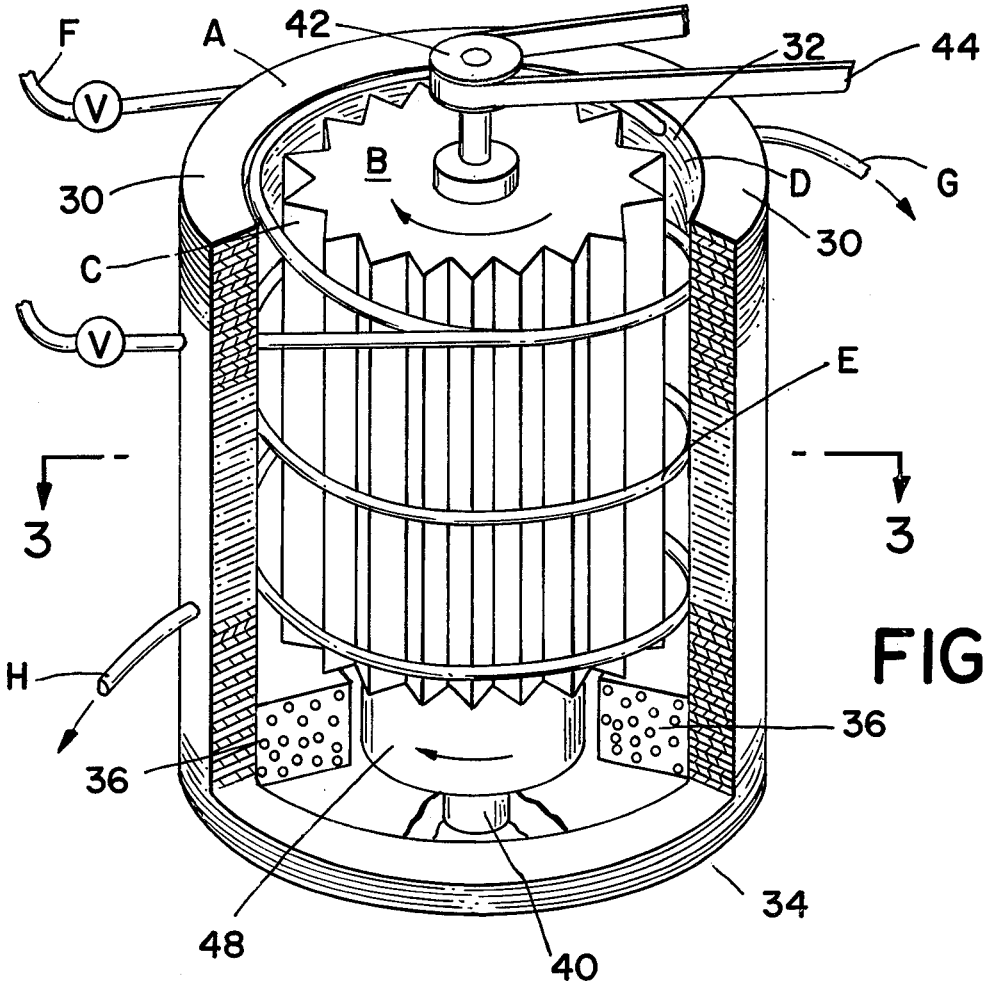
FIG. 1 is a perspective view of the separator of this invention shown with the stator cut away to expose the helical classifying conduit and the rotor.

Referring to FIG. 1, a stator A defining interiorly thereof a cylindrical volume has a rotor B having serrated edges C mounted therein for rotation. Serrated edges C define interior of a cylindrical cavity of the stator A a gap D. Gap D has placed therein a helical conduit E having a medially placed input F, an upper concentrate output G, and a lower tailings output H. By the expedient of continuously inputting mixed tailings and concentrate into the helical conduit E and rotating the rotor B with serrated edges C, a rotating magnetic field results which can be used to wind concentrate out the helical conduit E at output G while tailings flow gravitationally to output H.

Figure 2:
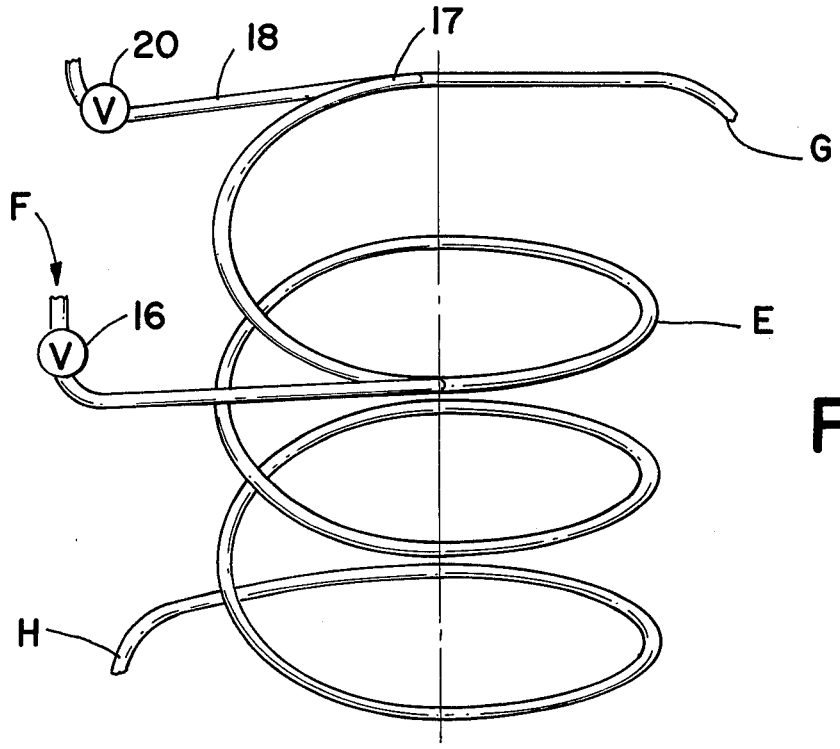
FIG. 2 is a perspective drawing of the helical classifying conduit only showing the concentrate output at the top of the helix, the tailings output at the bottom of the helix, and the medially located input (preferably placed at or near the top of the helix for the input of particles to be classified)

In explaining the operation of this invention, first the construction of the conduit will be fully set forth with respect to FIG. 2. Thereafter, with reference to FIGS. 1, 3 and 4, the construction of the stator and rotor will be described. Finally, operation of the classifying apparatus will be set forth.

Referring to FIG. 2, the substantially helical classifying path of the classifying conduit of this invention is illustrated, this illustration being without the presence of the rotor or stator. The classifying conduit as here shown consists of a spread out single layer conduit of non-conductive, non-magnetic material. For example, the conduit could be constructed of polyethelene or other substantially dielectric material.

Typically, this coil is supported on the stator. It comprises a conduit which is here shown preferably attached to the inside cylindrical surface of the stator. As here shown, the conduit has at all points along its length an equal uphill-downhill slope with respect to ambient gravitational bias. Thus, the axis of generation of the helix is parallel to the ambient force of gravitation or gravitational bias.

An input F for the continuous input of unclassified tailings and concentrate is illustrated communicated to one of the top loops of the helical classifying conduit E. By means of a throttle valve 16 the flow of unclassified concentrate and tailings can be monitored.

Typically, the tailings will gravitationally fall through the conduit E. They will fall from the input at F to the tailings output at H.

The path of the concentrate, however, will be in opposition. Typically, the rotating magnetic field produced by the rotor will wind the magnetic or paramagnetic particles in the uphill direction. These particles will be wound to the concentrate output at G.

It will usually be found necessary to dislodge the concentrate at the top of the helical conduit E from the rotating magnetic field. For this reason, a fluid jet 17 (preferably water) is introduced through a conduit 18 and controlled in intensity by a throttle valve 20. The fluid stream dislodges the concentrate at the top of the helical coil. Thus, the tailings output at G will consist of a mixture of liquid and classified tailings. It should be understood that the use of water is only illustrated as being preferred. Specifically, any apparatus for dislodging the concentrate particles from the top of the classifying conduit E could be used. For example, an air jet or a mechanical impeller or other apparatus could as well be used.

It should be understood that the helical classifying path E here illustrated has only been shown as a single conduit. It should be apparent that more than one helical conduit could be used. For example, the classifying conduit could consist of four separately wound helices, each of the helices defining its own classifying path.

Likewise, it will be understood that the dimensions and slope of the helical classifying conduit can be varied. These variations can be made either theoretically or empirically, dependent upon the particle size, the magnetic susceptibility of the magnetic or paramagnetic particles, the field intensity utilized, the percentage of solids present, or the desired feed rate of the classifier.

It should be emphasized that the helical coil here shown is wound on a cylinder. It could just as well be wound on a section of a cone with the apex of the cone being either towards the upper end of the coil or towards the lower end of the coil. The cylindrical wind of the helix construction here shown in preferred.

Having set forth the parameters of the helical classifying path, construction of the stator and rotor can now be described.

Typically, the stator is an element of high ferromagnetic conductivity. Broadly, it consists of cylindrical sidewalls 30 extending from the top of the stator down adjacent to the bottom of the stator. Walls 30 define there between a cylindrical volume 32 into which the rotor B is placed.

The bottom of the stator consists of a continuous disk of high conductivity ferromagnetic material. Thus, the bottom of the stator is closed by the disk so that cylindrical volume 32 is closed at the bottom end and open at the top end.

It is preferred that the stator be laminated. The laminations are preferably horizontal. These laminations resist eddy currents from being generated during stator rotation and thus permit rotation of the magnetic field with minimum energy loss.

The stator at its end adjacent the closed disk 34 is provided with a stationary coil 36. Coil 36 is conventional. It consists of a plurality of winds of conductive elements. As is well understood by those skilled in the art, the passage of electric current through the winds of the coil generates a north-south magnetic field. This north-south magnetic field can either be constant (as in the case of direct current) or alternating (as in the case of alternating current). The field generated by the coil in the preferred embodiment of this invention will be coaxial to the axis of the stator, the axis of the rotor, and the axis of generation of the helix of the classifying conduit E.

It should be emphasized that coil 36 does not rotate. Thus, no complex electrical connections such as commutators and the like are required.

Rotor B is typically mounted between a bottom bearing 40 and an upper bearing (not shown).

The rotor can be typically rotated by any conventional apparatus. As here shown, a pulley 42 rotated by an endless belt 44 effects rotation of the rotor. It is preferred that the rotation of the rotor can be variable. As will hereinafter become more apparent, the magnetic field can be varied in rotation by the expedient of varying rotor rotation.

Rotor B is typically cylindrical in overall shape. It includes laminations which, like those of the stator, are horizontal.

As here illustrated, the rotor extends through coil 36 at a reduced diameter section 48. This reduced diameter section enables a complete ferromagnetic path of high conductivity to occur so that the magnetic loop produced by the coil 36 can flow entirely within and through the separator at rotor A, bridging the gap B into which the helical classifying conduit E is placed.

Between the top of coil 36 and the top of the stator, rotor B is provided with a series of serrations D. Serrations D define areas of increased magnetic gradient as may best be illustrated with respect to FIGS. 3 and 4.

Figure 4:
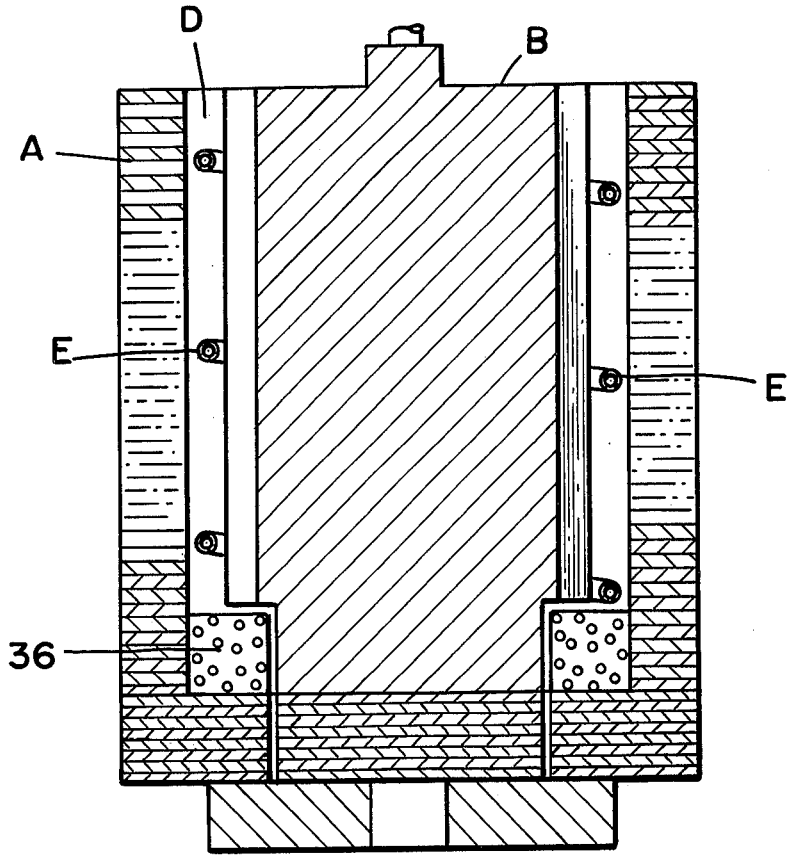

Referring to FIG. 4, it can be seen that coil 36 produces interior of stator A together with rotor B a loop which essentially confines the magnetic field produced by coil 36. Thus, the lines of flux of the coil pass through the stator and rotor and bridge the air space between the stator and rotor in the gap D wherein the classifying conduit E is located.

Figure 3:
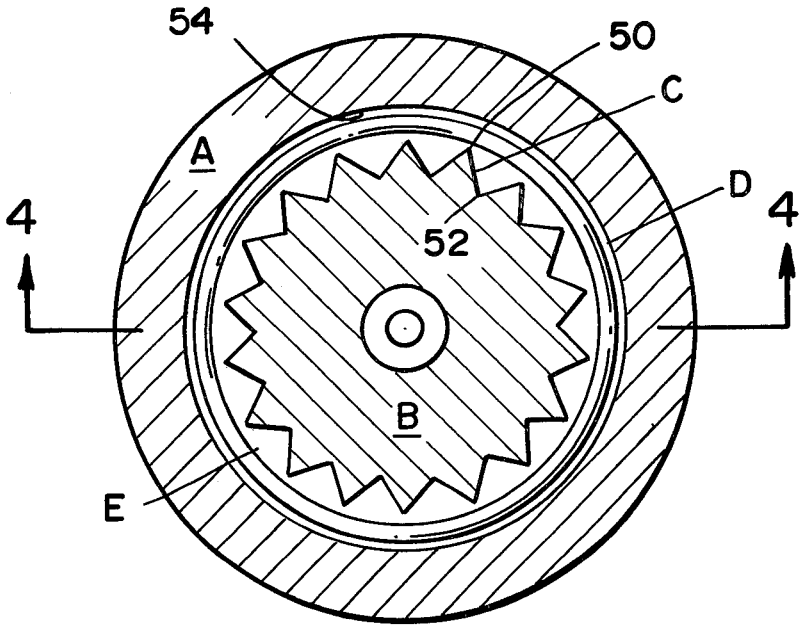
FIG. 3 is a plan view along a section of the separator taken at lines 3—3 of FIG. 1; and, FIG. 4 is a side elevation view taken along lines 3—3 of FIG. 4.

With reference to FIG. 3, the function of the serrations introducing enhanced magnetic gradient across the gap D can be explained. It is known by those skilled in the magnetic arts that where a gap is created in a ferromagnetic conductor across a field path, the density of the magnetic flux will be greatest at the point where the gap is narrowest and the reluctance to the magnetic field the smallest. Taking the case of the ridges and valleys produced by the serrations, the field intensity in the gap can be understood.

Assuming the ridge to ridge distance is equal to the ridge to sidewall distance, and assuming the valley to sidewall distance is twice the ridge to sidewall distance, a magnetic field intensity of 30,000 gauss produced across the gap at the ridges 50 of the serrations will produce a magnetic field intensity of approximately 15,000 gauss between adjacent ridges. Assuming that the ridge 50 to wall 54 distance is in the order of 2 inches, the difference in field intensity will average approximately 15,000 gauss per inch from each valley 52 to each ridge 50.

It should be understood that it is important that the difference in field intensity be produced around the circumference of the rotor. This is because this difference in field intensity or gradient entrains the magnetic concentrate to move uphill.

Regarding the dimensions of the serrations, it is preferred that the ridge define a gap which is one-half that of the gap defined by the valley. Moreover, the circumferential ridge to ridge spacing of the serrations should be approximately equal to the radial gap produced between the sidewall and valley.

It will thus be understood that the difference in magnetic field intensity is a function of the serrations at the rotor. Typically, these serrations are linearly disposed along the sidewalls of the rotor from the top of the classifying gap D down to the bottom of the classifying gap D.

It will likewise be seen that when the rotor B rotates with respect to the stator A, the differential field produced at the ridges of the serration C will likewise rotate. Thus, the rotation of the magnetic field will be purely a function of the rotation of the rotor.

Indeed, the rotation of the rotor can be maintained to rotate the magnetic field at an optimum rate and be varied to attain the desired rotational rate necessary to compliment the helical classifying path.

Having set forth the construction of the stator and rotor, the operation of the classifying apparatus can now be briefly described. In operation, intermixed tailings and concentrate are placed into the helical classifying conduit E through input F. Tailings gravitationally move against the rotating magnetic field through the helical conduit by the force of gravity from their input to the tailings output at H.

The movement of concentrate is opposite. Specifically, concentrate is wound by the rotating magnetic field in an uphill slope along helical conduits. This winding occurs from the input F up to the top of the helical conduit. At the top of the helical conduit a fluid jet 17 dislodges the concentrate to the tailings output at G.

Figure 5:
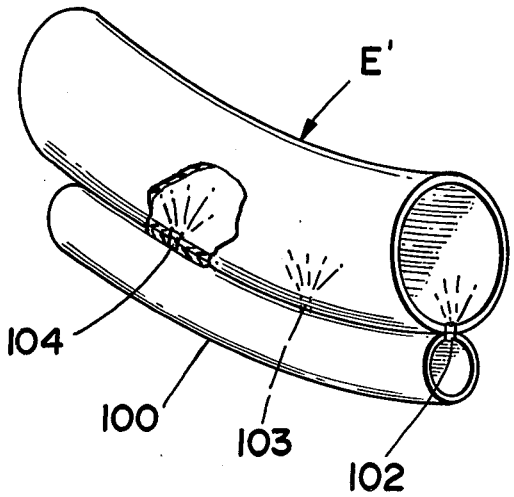
FIG. 5 is a perspective view of a conduit illustrating a manifold communicated to the classifying conduit for supplying water to the particles undergoing classification; and, FIG. 6 is a view of the arrangement of the conduits at the inlet.

Referring to FIG. 5, an embodiment of the helical classifying conduit is shown at E'. Broadly, the conduit containing mixed concentrate tailings is communicated immediately there below to a helical manifold 100. Manifold 100 is typically charged with water under pressure which discharges into the conduit E' at spaced manifold outlets 102, 103 and 104. During classification, a continuous flow of water is introduced to manifold 100 into the helical conduit E' in which classification is occurring.

It should be noted that the introduction of water into the conduit E' at the gravitationally lowest potential is preferred. Thus, the particles which would otherwise tend to coagulate the helical conduit at its lower portion are constantly disturbed and agitated by the injection of fluid, here shown as water.

It will be apparent to those skilled in the art that air could likewise be used for such an injection.

Figure 6:
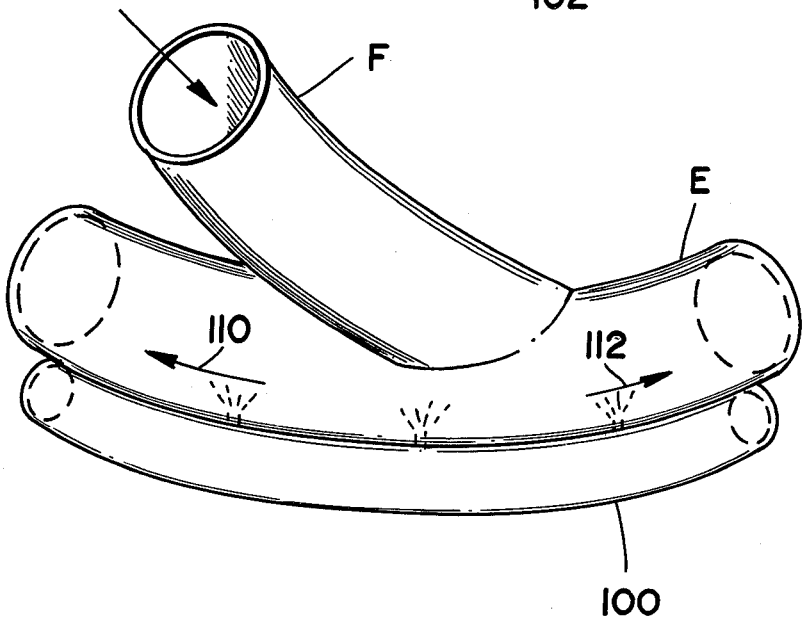

Referring to FIG. 6, a detail of the input conduit F into the classifying conduit E is illustrated. Broadly, conduit F is connected over and above conduit E so that it does not interfere with the winding of the concentrate in the direction of arrow 110 or the downward fall of the tailings in the direction of arrow 112. Moreover, it will be seen that by introducing the input from above at a relatively steep angle, concentrate will not be wound up the input. Moreover, the overhead introduction of input F into helical conduit E does not interfere with any manifold such as manifold 100 which may be used to provide constant agitation along the helical path.

It should be understood that this invention may be used with a number of modifications without departing from the spirit and scope thereof. Likewise, virtually any magnetic field can be used with this invention including those generated by permanent magnets or superconducting coils.

I claim:

1. A magnetic separator for continuously classifying mixed tailings and magnetic or paramagnetic concentrate comprising: a conduit defining a helical classifying path having an upper concentrate output, a lower tailings output, and an input for mixed concentrate and tailings therebetween; means for defining a high permeability magnetic field path on either side of said helical classifying path of said conduit including a stator on one side of said helical classifying path and a rotor on the other side of said helical classifying path with said conduit occupying a gap in said high permeability magnetic field path between said stator and rotor; means for generating a magnetic field communicated through said stator and rotor; a plurality of serrations on said rotor at said gap to produce areas of decreased magnetic reluctance across said gap and in said conduit; and, means for rotating said rotor to wind said concentrate at least from said input to said upper output of said helical classifying path.

2. The invention of claim 1 and wherein said means for generating a magnetic field includes a coil communicated to a source of electrical current.

3. The invention of claim 1 and wherein said helical classifying path is wound about a cylinder.

4. The invention of claim 1 and wherein said stator and rotor are laminated.

5. The invention of claim 1 and wherein said helical classifying conduit includes a manifold for injecting fluid at spaced intervals along its helical classifying path.

6. The invention of claim 5 and wherein said manifold injects water.

7. In the combination of a magnetic separator for continuously classifying magnetic or paramagnetic concentrate from ambient tailings including: a conduit defining a helical classifying path having an upper concentrate output, a lower tailings output, and an input for mixed tailings and concentrate therebetween; means for providing a rotating magnetic field for winding concentrate from said input to said concentrate output, the improvement in said means for providing a rotating magnetic field comprising: a stator defining an interior concavity for enclosing interiorly thereof said helical classifying path; means for generating a magnetic field communicated to said stator; a rotor mounted to the interior of said stator for rotation with said helical classifying path in a gap between said stator and rotor, said rotor at points adjacent said helical classifying path defining a plurality of serrations to define points of lowered magnetic reluctance between said stator and rotor; and, means for rotating said rotor to wind said concentrate from said input to said upper concentrate output.

8. The invention of claim 7 and wherein said stator and rotor are laminated normally to the axis of said rotor.

9. The invention of claim 8 and wherein the valleys of said serrations are twice as far away from the inside sidewall of said stator as are the ridges of said serrations.

10. The invention of claim 7 and wherein said serrations are axially aligned on said rotor parallel to the axis of said rotor.

11. The invention of claim 7 and wherein said serrations are of a V cross-sectional configuration.

12. The invention of claim 7 and wherein said serrations are skewed to the axis of said rotor.

* * * * *